United States Patent [19]

Marandel

[11] Patent Number: 4,915,399

[45] Date of Patent: Apr. 10, 1990

[54] SUSPENSION SYSTEM FOR ROLLER SKATES AND SIMILAR DEVICES

[76] Inventor: Jean-Bernard Marandel, 4. rue de la République, 93450 L'ile Saint-Denis, France

[21] Appl. No.: 177,732

[22] Filed: Apr. 5, 1988

[51] Int. Cl.[4] ..... A63C 17/02

[52] U.S. Cl. ..... 280/11.28

[58] Field of Search ..... 280/11.19, 11.27, 11.28

[56] References Cited

U.S. PATENT DOCUMENTS

| | | | |
|---|---|---|---|
| 2,128,865 | 8/1938 | Vogt | 280/11.28 |
| 2,330,338 | 9/1943 | Dekome et al. | 280/11.28 |
| 2,558,696 | 6/1951 | Horn | 280/11.28 |
| 2,664,295 | 12/1953 | Horn | 280/11.28 |
| 3,774,924 | 11/1973 | Machatsch | 280/11.28 |
| 4,402,521 | 9/1983 | Mongeon | 280/11.28 X |

FOREIGN PATENT DOCUMENTS

| | | |
|---|---|---|
| 437528 | 4/1912 | France . |
| 1489079 | 6/1967 | France . |
| 1583171 | 9/1969 | France . |
| 418699 | 10/1934 | United Kingdom . |

*Primary Examiner*—Charles A. Marmor
*Assistant Examiner*—Michael Mar
*Attorney, Agent, or Firm*—Sughrue, Mion, Zinn, Macpeak & Seas

[57] ABSTRACT

The invention relates to roller skates, equipped at the level of the front and rear pivoting axles, with a suspension system for damping shocks resulting from uneveness of a skating surface. The front and rear pivoting axles (8, 8') are each provided with a suspension system (9, 9') which is fixed at one end on the central part (10, 10') of the pivoting axle; and at the other end being guided by a centering barrel (17) located inside a base (3) of the skate. The pivoting axles are also each equipped with a pivoting system (7, 7') secured at one end to the base by a pivoting device (11, 11') while the other end is secured to an arm (12, 12') of the central part by resilient washers (13, 13').

9 Claims, 2 Drawing Sheets

SUSPENSION SYSTEM FOR ROLLER SKATES AND SIMILAR DEVICES

BACKGROUND OF THE INVENTION

The present invention relates to roller skates having suspension systems on the front and rear axles.

This invention applies to roller skates and skate boards of the type upon which the user puts his two feet on the board, the advance of which is directed by the inclination of the board. These two types of rolling machines will be hereinafter designated under the generic expression of "roller skates".

Skates of the type equipped with a shoe fixed onto a sole are well known in the field of roller skates, the sole being secured to a base having on its front part a bumper acting as a brake and having front and rear running under-carriages, each of them comprising two conventional roller skate wheels, freely rotating on a fixed (i.e. non-rotatable) axle, and means for suspending the wheels.

These means for suspending the wheels are actuated by the force applied by the weight of the skater in relation to the position of this force with respect to the longitudinal axis of the skate. These suspending means are generally composed of elastic washers secured to the non-rotatable axle by means of nuts and counter-nuts, in order to allow articulation and orientation movements of the non-rotatable axle.

Nevertheless, this system of resilient guidance does not provide damping and suspension functions when the skate runs upon an obstacle.

SUMMARY OF THE INVENTION

The object of the invention is to eliminate these inconveniences by introducing a suspension device at the level of the axles of a skate, the axles being made pivotable relative to the skate base. The aim of the suspension device is, on the one hand to prevent the roller skate, as much as possible, from being subjected to the shocks and vibrations resulting from the uneveness of the skating surface and, on the other hand to assure that the skater has maximum operating convenience when skating.

The present invention applies to a roller skate of the type having a shoe fixed onto a sole secured to a base, and comprising a brake or bumper fixed on the front part of the base, front and rear running undercarriages equipped with two wheels, suspension means for the wheels, and an axle on which the wheels are rotatably mounted.

In order to eliminate the drawbacks hereinabove cited, the invention consists in providing front and rear pivoting axles having suspension devices, said devices being secured at one end on the center part of the pivoting axle, right on the axis of the wheels, and the other end is guided by a centering barrel located inside the base. These pivoting axles are also provided with means for pivoting the wheels relative to the skate base, each such means being secured at one end to the base by pivoting or swiveling means, and at the other end to an arm of the pivoting axle by resilient washers.

The invention will be presented hereinafter with more details, referring to the accompanying drawings representing only a preferred embodiment.

DETAILED DESCRIPTION OF A PREFERRED EMBODIMENT

Figure 1:
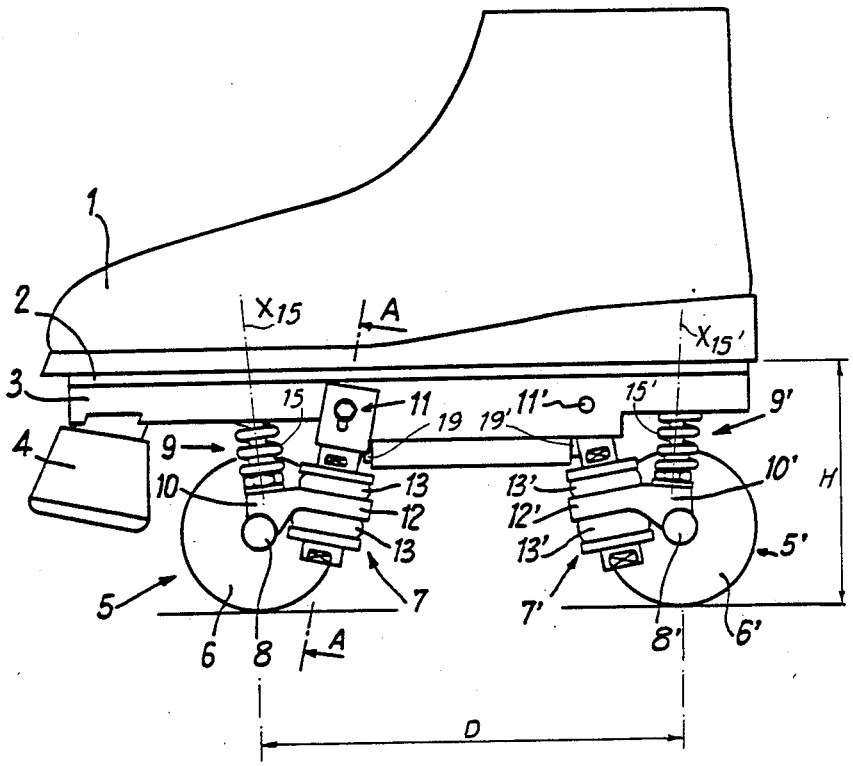
FIG. 1 represents a side view, at a reduced scale, of the skate according to the invention.

The roller skate, represented in FIG. 1, comprises a shoe (1) fixed to a sole (2), secured to a base (3), and is provided with a brake or cushion bumper (4) fixed on the bottom of the base, and has front and rear carriages (5, 5'), each of them fitted with a pair of wheels (6, 6'), an axle pivoting device or system (7, 7') for the wheels and a wheel-supporting pivotable axle (8, 8').

Figure 2:
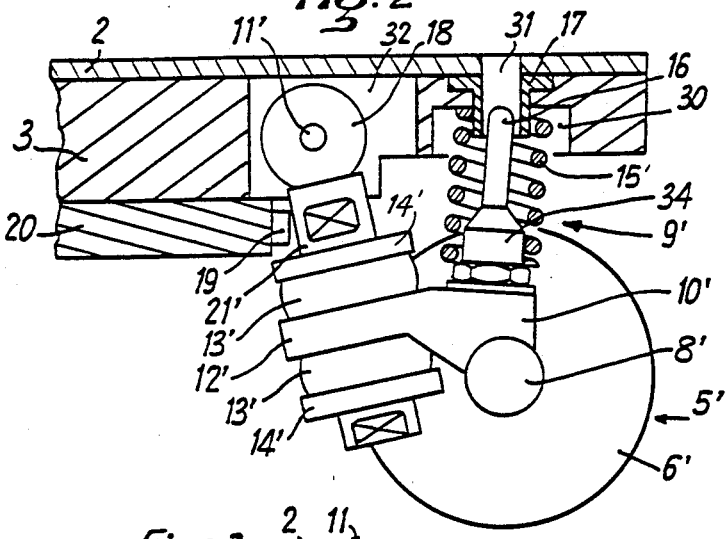
FIG. 2 represents, at a full scale, details of the part constituting the rear portion of the skate, on a partial longitudinal section.

The rear rolling carriage (5'), represented in FIG. 2, shows in detail a wheel-supporting pivotable axle (8') provided with a suspension system (9'), the latter being secured at one end in the center part of the axle member (10), right to the axis of the wheels (6'), and other end being guided by a centering barrel (17) located inside the base (3); the member (10) with its axle (8') being provided with the pivoting means (7') for pivoting the axle relative to the base (3), the pivoting means being secured at one end to the base (3) by pivot means (11') while the other end is secured to an arm (12') integral with axle member (10') by resilient means consisting of two rubber washers (13', 13'). The suspension system for the front rolling carriage is based on the same principle as for the rear carriage represented in FIG. 2; therefore, only the rear suspension system will be described in detail.

This rear suspension system (9') is composed of a spring (15') and a centering finger (34), the latter being screwed at one end in the axle member (10') of the pivoting axle (8'), while the other end is extended by a pin (16) guided by the inner surface of the centering barrel (17), the spring being guided upward by the outer surface of the centering barrel. The stiffness of spring (15') is selected in accordance with the weight of the user of the skate.

The centering barrel (17) of the suspension system (9') opens downward into a cavity (30) and is cut through a bore (31), of an oblong shape, which extends through the sole (2). The width of the oblong bore (31) is approximately equivalent to the diameter of pin (16). The centering barrel is made of a self-lubricating material in order to allow the pin (16) of the centering finger (34) to freely slide in the oblong bore (31) of the barrel.

The operating mode of the suspension system is as follows:

FIG. 1 illustrates the roller skate in its relaxed condition during which no load is applied to the top of the skate. During such condition it should be noted that springs (15, 15') are fully extended under a slight compression, bringing pivoting systems (7, 7') in contact with bumpers (19, 19'), respectively. Also to be noted, the spring axes $X_{15}$, $X_{15}$, are tilted slightly from the vertical: $X_{15}$ slightly forwardly, and $X_{15}$, slightly rearwardly. In this relaxed condition, the variable wheelbase D is at its shortest or minimum length or distance, while the variable distance H between the top of sole (2) and the ground is at a maximum.

Figure 4:
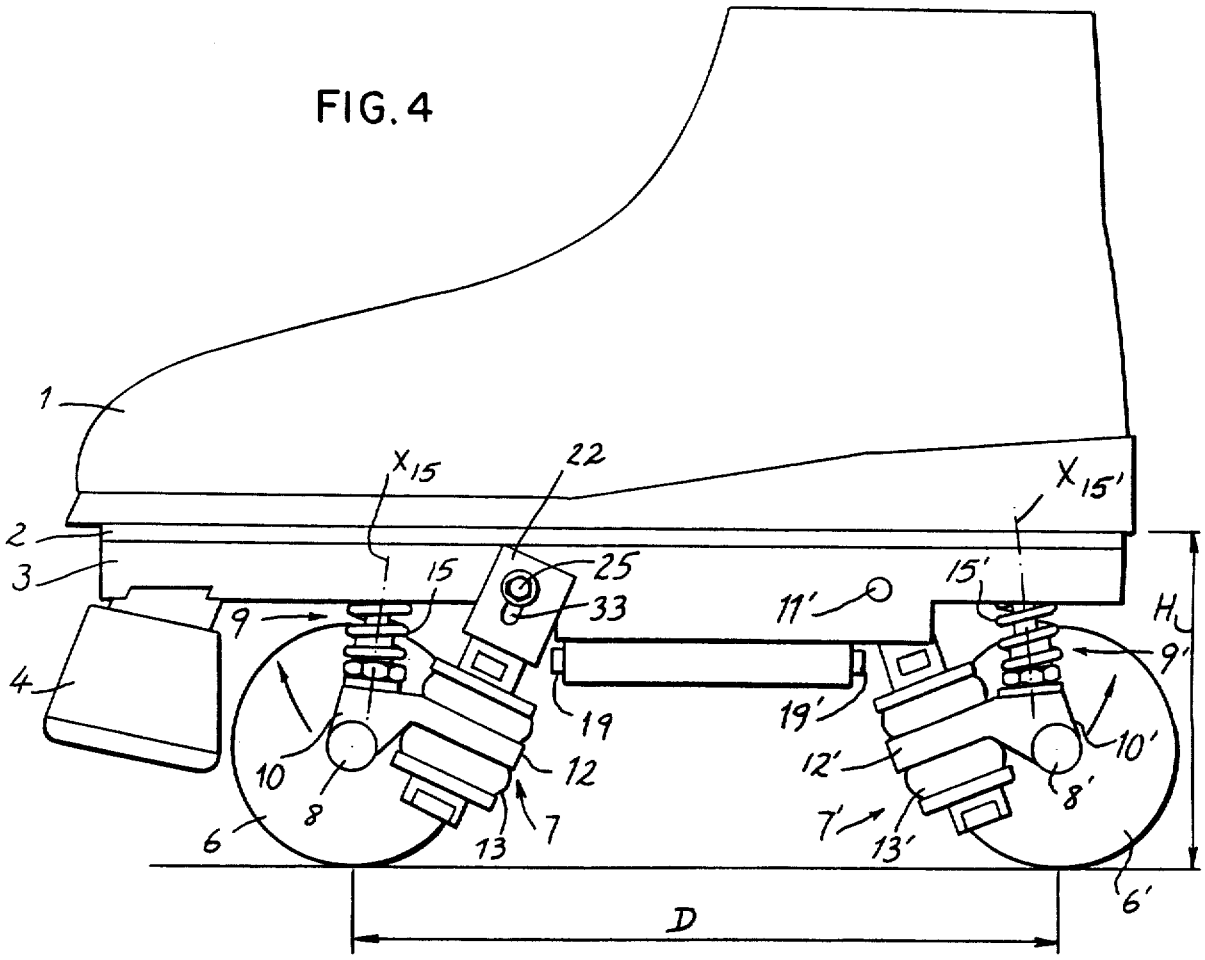
FIG. 4 represents a side view of the skate according to the invention during use under normal conditions.

FIG. 4 illustrates the condition of the skate during normal operation when a downwardly directed load (i.e. the weight of a skater) is applied to the top of a skate. It will be noted that springs (15, 15') are partly compressed, pivoting systems (7, 7') have moved away from bumpers (19, 19'), wheelbase D has increased, and distance H has decreased. Suspension systems (9, 9') will accommodate variations in load which occur when the skater transfers part of his weight from one foot to the other, while resilient washers (13, 13') will absorb vibrations due to small irregularities in the ground surface. Thus, the suspension system operates in a manner somewhat similar to that of an automobile suspension.

When the rear wheels (6') of the skate meet with some obstacle, they will tend to move upward and rearward of the skate in order to stress the suspension system (9'). This vertical movement of the wheels will result in a pivoting movement of the axle member (10') with axle (8') relative to the pivot axis (11'). Coming nearer to the base (3), the pivoting axle puts a compressive stress on the suspension system (9'). The spring (15') will be compressed and will operate as a damper. The pin (16) of the centering finger (34) penetrates into the bore (31) of the centering barrel (17).

In the rear carriage (5'), the pivoting system (7') for the wheels is located before the suspension system.

According to the invention, the rear pivoting axle member (10') with axle (8') has a pivoting system (7') for the wheels, the upper end of which is pivotally secured to the base (3) and which is composed of a pivot pin (11') and a pivot hub (18), cylindrically shaped, disposed in a cavity (32) of the base (3), the parallel external faces of the pivot hub being in close contact with the corresponding surfaces of the cavity (32). The pivoting system is composed of an articulated arm (21'), the two resilient washers (13') sandwiching axle arm 12', and the two counter-nuts (14').

After damping the shock, the pivoting system returns to its normal position. A bumper (19') is provided to damp the return of the articulated arm (21') against a gusset (20) which is fixed onto the bottom face of the base (3) and is provided at each end with a bumper (19 or 19') in order to damp the shock after the return of the articulated arm (21' or 21).

Figure 3:
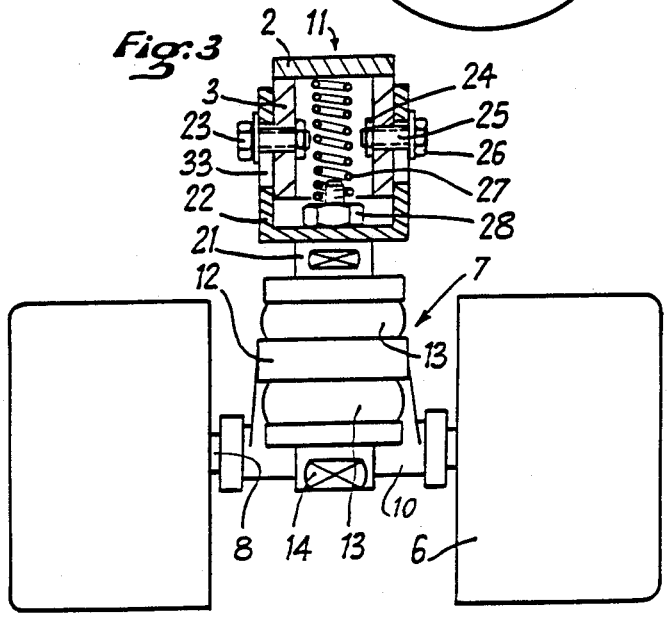
FIG. 3 represents, at a full scale, details of the part relating to the pivoting device of the front carriage, according to a cross section along line A—A of FIG. 1.

The front rolling carriage represented in FIG. 3 shows the pivoting system (7) according to the cross-section along line AA of FIG. 1. In this figure, the suspension system (9) is not shown since its construction is the same as for the rear rolling carriage of the skate (refer to FIG. 2).

In the front carriage (5), the pivoting system (7) for the wheels is located behind the suspension system (refer to FIG. 1).

According to the invention, the front axle member (10) comprises a pivoting system (7) for the wheels, the upper end of which system also is pivotally secured to the base (3) and is composed of two pivot pins (25), and a U-shaped cover (22) the parallel flanges of which are in close contact with the respective external faces of the base. These two flanges of the cover have two oblong openings (33) which allow, in relation to the two pins (25), a vertical clearance movement of the pivoting system.

Figure 5:
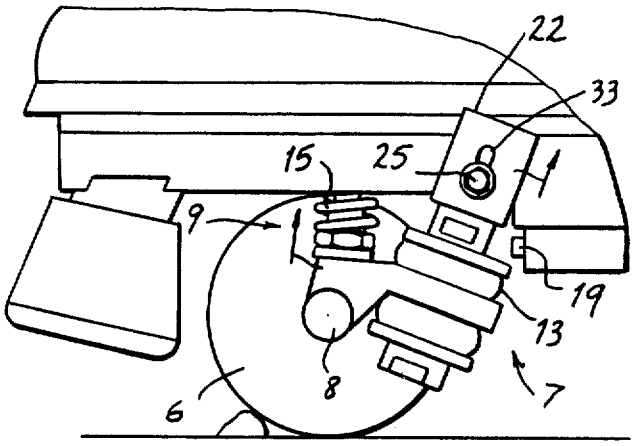
FIG. 5 is a fragmentary side view of the front carriage while meeting an obstacle.

The operating mode of the front suspension system is as follows:

As best seen in FIG. 5, when the front wheels (6) of the skate meet with some obstacle, they will tend to move upward, in order to put stress on the suspension system (9). This movement of the wheels, and consequently of the front pivotable axle is directed upward and also rearward of the skate. The suspension system (9) will be stressed normally; however, in order to obtain a small pivoting movement of the axle member (10) and axle (8) relative to the pivot means (11), it is necessary to have a pivoting system (7), the upper end of which is secured to the base (3) via a flexible pivot means. For this result, the upper part of the pivoting system is provided with the U-shaped cover (22), the two parallel flanges of which, surrounding the base (3), are provided with the two oblong openings (33). These openings are crossed through by the two pivoting pins (25) in order to provide a flexible swiveling means for the directing system.

A pull-back spring (27) allows return to the initial position of the cover (22) after passing onto the obstacle.

A front and a rear carriage of a roller skate have been presented in the course of the description. The suspension system is of same construction for both carriages. The pivoting systems are different by their positioning, at the level of the axles.

The suspension and pivoting systems applied hereinabove result in an improvement of the suspension techniques for roller skates.

What is claimed is:

1. Roller skate of the type having a shoe (1) fixed onto a sole (2) secured to a base (3), a brake (4) secured to the front part of said base, front and rear undercarriages (5, 5') each with a pair of wheels (6, 6'), a pivoting system (7, 7') for each pair of wheels, and an axle (8, 8') for rotatably supporting each pair of wheels, characterized: in that the front and rear axles are pivoting axles (8, 8') each of which is provided with a suspension system (9, 9'), the latter being secured at one end thereof on a central part (10, 10') of the pivoting axle, right to the axis of the wheels (6, 6'), and the opposite end thereof being guided by a centering barrel (17) located inside the base (3); and in that each pivoting axle is provided with a pivoting system (7, 7') pivotally secured at an upper end thereof to the base (3) by pivot means (11, 11') while a lower end thereof is secured to an integral arm (12, 12') of the pivoting axle by resilient means (13, 13'); and in that the upper end of the pivoting system (7) of the front pivoting axle (8) comprises: two pivot pins (25); a U-shaped cover (22), two parallel flanges of which are in close contact with respective external faces of the base, these two flanges of the cover being provided with two oblong openings (33) which allow a vertical clearance movement of the pivoting system (7) in relation with the two axles pins (25); and a pull-back spring (27) for the U-shaped cover (22).

2. Roller skate according to claim 1, characterized in that the centering barrel (17) of the suspension system (9, 9') of the front and rear undercarriages (5, 5') opens downward into a cavity (30), and in that this centering barrel, which is cut through by a bore (31) of oblong shape, extends through the sole (2).

3. Roller skate according to claim 2, characterized in that the oblong shaped bore (31) has a width which is approximately equivalent to the diameter of a pin (16) of the suspension system (9, 9').

4. Roller skate according to claim 2, characterized in that the centering barrel (17) is made of a self-lubricating material.

5. Roller skate according to claim 1, characterized in that the upper end of the pivoting system (7') of the rear axle (8') comprises a pivot axis (11) and a cylindrically shaped pivot hub (18) disposed in a cavity (32) inside the base (3), parallel external faces of the pivot hub being in close contact with corresponding surfaces of said cavity (32).

6. Roller skate according to claim 1, characterized in that each of the front and rear suspension systems (9, 9') is composed of a spring (15) and a centering finger (34), the latter being screwed at one end thereof in the central part (10, 10') of the revolving axle, while the other end is extended by a pin (16) guided by the inner surface of the centering barrel (17), the spring being guided upward by the outer diameter of this centering barrel.

7. Roller skate according to claim 6, characterized in that the stiffness of springs (15) forming part of the front and rear suspensions is selected in accordance with the weight of the user of the skate.

8. Roller skate according to claim 1, characterized in that a gusset (20), fixed onto the bottom face of the base (3) is provided at both ends with buffers (19) in roder to damp shock by the articulated arms (21, 21') when the latter are returning to normal position.

9. A roller skate of the type having a shoe (1) fixed onto a sole (2) secured to a base (3), a brake (4) secured to the front part of said base, front and rear running carriages (5, 5') each with a pair of wheels (6, 6'), a pivoting system (7, 7') for each pair of wheels, and an axle (8, 8') for rotatably supporting each pair of wheels, characterized in that:

said front and rear axles (8, 8') are each provided with a suspension system (9, 9') one end of which is secured on a central part (10, 10') of the axle, right to the axis of the wheels (6, 6'), and the opposite end of which is guided by a centering barrel (17) located inside the base (3);

each axle is equipped with a pivoting system (7, 7') secured at an upper end thereof to the base (3) by pivoting means (11, 11') while a lower end thereof is secured to an integral arm (12, 12') of the axle by resilient means (13, 13');

each of the suspension systems (9, 9') comprises a spring (15) through which passes a centering finger (34) whose lower end is screwed in the central part (10, 10') of the axle, and whose upper end is extended by a pin (16) guided by an inner surface of said centering barrel (17), the upper part of the spring being guided upward by an outer surface of said centering barrel;

the pivoting system (7') of the rear axle (8') comprises a pivot axis (11') and a cylindrically shaped spindle (18) located in a cavity (32) inside the base (3);

the pivoting system (7) of the front axle (8) comprises a pair of pivot pins (25), a U-shaped cover (22) having two parallel flanges in close contact with corresponding lateral faces of the base (3), said flanges having two oblong openings (33), said pivot pins (25) passing through said openings (33) and through openings in said corresponding lateral faces of the base (3), and a pullback spring (27) for the U-shaped cover (22); and a gusset plate (20) is fixed on a lower face of the base (3) in an area located between the two pivoting systems (7, 7') for the two pair of wheels, and is provided at opposite ends with bumpers (19, 19') for damping shocks by articulated arms (21, 21') of the pivoting systems when the latter are returning to normal position.

* * * * *

UNITED STATES PATENT AND TRADEMARK OFFICE
CERTIFICATE OF CORRECTION

PATENT NO. : 4,915,399

DATED : April 10, 1990

INVENTOR(S) : Jean-Bernard MARANDEL

It is certified that error appears in the above-identified patent and that said Letters Patent is hereby corrected as shown below:

The title page, showing the number of Drawing Sheets, should be deleted to be replaced with the attached title page.

IN THE DRAWINGS:

Please add the attached drawing sheet containing Fig. 4 and Fig. 5.

Signed and Sealed this

Tenth Day of December, 1991

*Attest:*

HARRY F. MANBECK, JR.

*Attesting Officer*

*Commissioner of Patents and Trademarks*

United States Patent [19]

Marandel

[11] Patent Number: 4,915,399

[45] Date of Patent: Apr. 10, 1990

[54] SUSPENSION SYSTEM FOR ROLLER SKATES AND SIMILAR DEVICES

[76] Inventor: Jean-Bernard Marandel, 4, rue de la République, 93450 L'ile Saint-Denis, France

[21] Appl. No.: 177,732

[22] Filed: Apr. 5, 1988

[51] Int. Cl.[4] ..... A63C 17/02

[52] U.S. Cl. ..... 280/11.28

[58] Field of Search ..... 280/11.19, 11.27, 11.28

[56] References Cited

U.S. PATENT DOCUMENTS

| | | | |
|---|---|---|---|
| 2,128,865 | 8/1938 | Vogt | 280/11.28 |
| 2,330,338 | 9/1943 | Dekome et al. | 280/11.28 |
| 2,558,696 | 6/1951 | Horn | 280/11.28 |
| 2,664,295 | 12/1953 | Horn | 280/11.28 |
| 3,774,924 | 11/1973 | Machatsch | 280/11.28 |
| 4,402,521 | 9/1983 | Mongeon | 280/11.28 X |

FOREIGN PATENT DOCUMENTS

| | | |
|---|---|---|
| 437528 | 4/1912 | France . |
| 1489079 | 6/1967 | France . |
| 1583171 | 9/1969 | France . |
| 418699 | 10/1934 | United Kingdom . |

*Primary Examiner*—Charles A. Marmor
*Assistant Examiner*—Michael Mar
*Attorney, Agent, or Firm*—Sughrue, Mion, Zinn, Macpeak & Seas

[57] ABSTRACT

The invention relates to roller skates, equipped at the level of the front and rear pivoting axles, with a suspension system for damping shocks resulting from unevenness of a skating surface. The front and rear pivoting axles (8, 8') are each provided with a suspension system (9, 9') which is fixed at one end on the central part (10, 10') of the pivoting axle; and at the other end being guided by a centering barrel (17) located inside a base (3) of the skate. The pivoting axles are also each equipped with a pivoting system (7, 7') secured at one end to the base by a pivoting device (11, 11') while the other end is secured to an arm (12, 12') of the central part by resilient washers (13, 13').

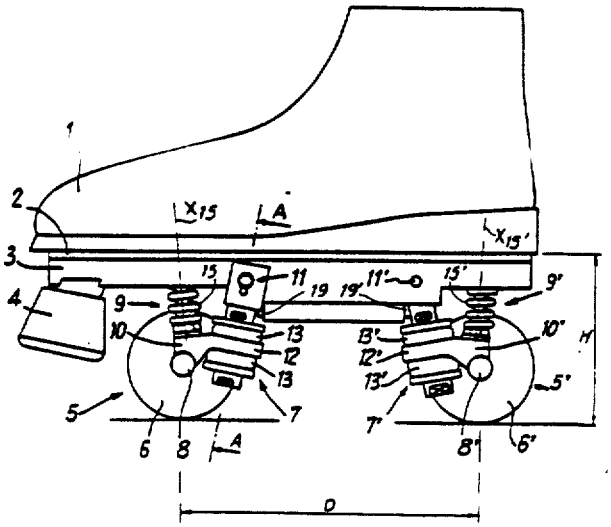

9 Claims, 3 Drawing Sheets